US006053661A

United States Patent [19]

Lewis

[11] Patent Number: 6,053,661

[45] Date of Patent: Apr. 25, 2000

[54] VARIABLE FITTING FOAM BLOCKS AS AGGREGATE

[75] Inventor: David L. Lewis, Woodbury, Conn.

[73] Assignee: Polar Industries, Inc., Prospect, Conn.

[21] Appl. No.: 08/976,429

[22] Filed: Nov. 21, 1997

[51] Int. Cl.[7] ..... E02B 11/00

[52] U.S. Cl. ..... 405/36; 405/258; 52/592.2; 52/604

[58] Field of Search ..... 405/284, 286, 405/229, 273, 50, 258; 52/592.6, 592.1, 605, 589.1, 592.2, 603, 604, 607

[56] References Cited

U.S. PATENT DOCUMENTS

| | | | |
|---|---|---|---|
| 263,914 | 9/1882 | Kern | 52/592.1 |
| 903,906 | 11/1908 | Soss | 52/592.6 |
| 2,183,657 | 12/1939 | Page . | |
| 2,639,909 | 5/1953 | Leva . | |
| 3,233,414 | 2/1966 | Hansen et al. . | |
| 3,626,702 | 12/1971 | Monahan | 405/229 |
| 3,747,353 | 7/1973 | Monahan | 405/284 |
| 4,411,555 | 10/1983 | Minvielle et al. | 405/50 |
| 4,787,185 | 11/1988 | Gascho | 52/605 |
| 4,983,068 | 1/1991 | Kozak et al. | 405/36 |
| 5,015,123 | 5/1991 | Houck et al. | 405/45 |
| 5,051,028 | 9/1991 | Houck et al. | 405/45 |
| 5,304,423 | 4/1994 | Niknafs et al. | 428/402 |
| 5,365,714 | 11/1994 | Potvin | 52/603 |
| 5,516,229 | 5/1996 | Atchley et al. | 405/36 |
| 5,549,418 | 8/1996 | Devine et al. | 405/284 |

FOREIGN PATENT DOCUMENTS

| | | | |
|---|---|---|---|
| 862121 | 2/1941 | France | 52/605 |
| 948077 | 8/1956 | Germany | 52/605 |

*Primary Examiner*—Eileen Dunn Lillis
*Assistant Examiner*—Frederick L. Lagman
*Attorney, Agent, or Firm*—Ware, Fressola, Van Der Sluys & Adolphson LLP

[57] ABSTRACT

Specially-shaped blocks of foam for use underground as aggregate. Because of protuberances on the faces of the blocks, the blocks fit closely together in only a small number of ways. In filling a volume, the overwhelmingly more likely arrangements provide a reasonably certain percentage void. Thus, the blocks can be transported to an application arranged without any significant void, and then used to fill a volume, providing a reasonably well known percentage void and compressive strength. Use of these foam blocks can provide thermal insulation, cushioning and various combinations of compressive strength and void, depending on the size and shape of the blocks and the size and shape of the protuberances relative to the blocks.

8 Claims, 8 Drawing Sheets

VARIABLE FITTING FOAM BLOCKS AS AGGREGATE

BACKGROUND OF THE INVENTION

1. Field of the Invention

This invention relates to new forms of granular and haphazardly arranged aggregate employed in septic drainage fields, underground burial storm-water storage, and drainage systems. In particular, such aggregate must provide interstices an void passageways therethrough for the percolation of drainage water and for the evaporation of moisture in air or gases ventilated through the aggregate, while providing load-carrying stability as backfill, stabilizing the surface grade and carrying pedestrian and vehicle traffic within predetermined load limits.

Specifically, the present invention is a specially-shaped block for use as synthetic aggregate, the shape providing a certain combination of void and compressive strength when the blocks are used to fill a volume.

2. Prior Art

There are a number of applications in which there is a need to fill an underground volume with material that will provide some compressive strength able to support loading from above, and some void for providing a passageway for air or fluid, and also, in some cases, some thermal insulation isolating what is below or within the volume from the thermal environment above ground. In these applications, the material must almost always be transported to the underground volume to be filled, and then distributed in some manner throughout the volume.

In the past, stone aggregate has been used. Stone aggregate, however, is sometimes not uniform in its size, shape or composition, so in using it there is uncertainty in meeting the requirements of an application. In addition, stone aggregate has to be mined (as gravel), affecting some ecosystems. Moreover, stone aggregate is heavy and so more costly to transport and to distribute throughout the volume of an application. Finally, even when using washed, crushed stone as aggregate, since all stone has silt, there will still be a membrane formed from the silt of the aggregate in the bottom of any volume filled with the aggregate. Silt build-up is unpredictable and, in case of a drain-field application, greatly reduces the lifetime and efficiency of the drain system.

There is also in the prior art the use of expanded polystyrene tubes as aggregate. Houck (U.S. Pat. Nos. 5,015,123 and 5,051,028) teaches using various shapes such as plastic balls, styrofoam peanuts, tubes, and chunks of polypropylene, PVC or other light material. Houck therefore teaches using for aggregate foam in shapes that either fit closely together, as in the case of a cube, or that cannot be fit closely together, i.e. will always have in any arrangement a substantial percentage void.

The use of odd shapes of one or another kind of material for use as aggregate is also taught by Minvielle et al. (U.S. Pat. No. 4,411,555). However, the shapes taught by Minvielle et al. rely on internal passageways for allowing the movement of air or fluid.

In all of the prior art, void is provided in the volume to be filled either by choosing irregular shapes to comprise the aggregate or choosing hollow, nonclosed shapes providing internal passageways. In many applications there is a need for substantial void in the settled aggregate, often over 40%. In addition, there are some applications where the aggregate must provide greater compressive strength than is usual. A hollowed open shape can be made of different sizes to change the percentage void, or can be made more or less hollow, but there will always be a significant void in any assembly of these shapes because of the ever-present internal passageways. Moreover, these hollow open shapes are not capable of providing the same compressive strength as solid shapes made of the same material.

In the case of irregular solid shapes, the percentage void is fixed by the shape. Making the same shape larger or smaller will not significantly change the percentage void. Thus, the compressive strength offered by these shapes is also fixed, because compressive strength depends in some way inversely on the void provided by the shapes comprising the aggregate.

Thus, in transporting any of these shapes to an application, because there is no way to arrange the shapes of the prior art to eliminate void, the void must also be transported. Although the void weighs nothing, it occupies volume, and transporting it has a cost.

What is needed as aggregate are shapes that fit together for transporting to an application and that, when distributed throughout a volume, will almost never fit together, but will instead provide a desired void. What is also needed is a shape that can be tailored to provide different combinations of void and compressive strength, depending on the application.

SUMMARY OF THE INVENTION

The present invention is a specially shaped block for use with other identical blocks as underground aggregate. The blocks are shaped depending upon the application to provide different combinations of void and compressive strength when used to fill a volume. The blocks are made to fill a volume by distributing them throughout the volume with some minor disorder. Because there are only a very small number of arrangements of the blocks having little or no void, in distributing the blocks in a volume the blocks almost invariably provide a pre-determined void.

In other words, the blocks are shaped to fit together with little or no void when arranged in a small number of ways, but in the act of filling a volume with the blocks, the assembly will almost always provide a predictable void. Thus, the blocks may be transported to an application in a no-void configuration, and then distributed with even only slight randomness, to provide the predictable void. Each block is essentially identical with every other block, and the shapes are such that the manufacture of a number of the blocks results in one of the few possible numbers of close-fitting assemblies, rather than the very much more likely void-providing assemblies.

In the preferred embodiment, each block is a cubical form substantially two inches on a side and made from expanded polystyrene (foam) with two or three ribs and grooves along the width of each face. A number of these blocks can be assembled so that the ribs of some blocks mate with the grooves of the others, thereby eliminating essentially all void in the assembly. In the preferred embodiment, one face of a block will mate with only one of six faces of another block when all blocks are arranged in a close-fitting assembly. Thus, the probability that, in a random assembling of blocks, each face of a given block will be aligned with a face of another block necessary for a no-void configuration is one-sixth to the sixth power. Even then, each block must have an angular orientation, relative to adjacent blocks, in a certain range, so that the ribs and grooves line up. Therefore, simply dumping a large number of these blocks in a volume will almost invariably result in significant void. Moreover, it turns out that in the vast majority of arrangements having void, the void is essentially the same. Thus, the blocks of the present invention are very likely to provide a void that is known in advance, and known with some certainty.

In the present invention, the blocks can be made larger or smaller, depending upon how irregular the shape to be filled. Smaller blocks will conform more closely to the surface of an irregular volume. The protuberances, such as ribs and grooves as in the preferred embodiment, can themselves be larger or smaller and shaped variously, as long as all blocks are essentially the same in shape, and as long as there are some assemblies in which all of the blocks fit closely together, without any significant void. To meet the requirements of an application calling for greater compressive strength, depending on the requirement for void, the protuberances would be made smaller for the same sized block. Greater void, although with less compressive strength, is provided by exaggerating the protuberances.

The special foam shapes of the present invention, in the preferred embodiment of two-inch blocks, provide approximately 43% void and a compressive strength of roughly 13.2 psi, Advantageously, as pointed out above, using such shapes eliminates much uncertainty in the design of systems for various applications requiring fluid or air flow. Finally, these shapes, costing approximately one-half as much as the shapes of the prior art to transport to an application (on account of their being assembled for transport without void) will stimulate their use and argue against mining gravel.

The present invention is also used advantageously for providing insulation, especially in situations where what is insulated may have to shed moisture, because the thermal blanket provided by the blocks of the present invention will allow the insulated object to breathe. So, for example, when burying cable splice or junction boxes underground in cold climates, a six-inch blanket of blocks according to the preferred embodiment will provide excellent thermal insulation, but at the same time will provide a path for the escape of moisture.

Other kinds of applications in which the present invention can be used advantageously include:

- preventing shifting to the point of damage of underground lines;
- helping prevent sharp shales and stones from piercing underground cable;
- preventing freezing of water lines, and preventing fracturing of leaking cable conduit due to excessive movement;
- preventing a water line from leaking following a frost heave that fractures joints in the water line;
- stabilizing soil, especially in wet areas;
- providing a predictable water drain-off system, and so helping prevent water from infiltrating a cable laid in the drained area; and
- insulating piping near the stones of a stone-lined ditch, the insulation needed because stones cold from a winter freeze will draw heat from the piping.

BRIEF DESCRIPTION OF THE DRAWINGS

The present invention will become more fully apparent as the description that now follows is read in conjunction with the accompanying drawings, in which.

DESCRIPTION OF THE PREFERRED EMBODIMENT

Figure 1:
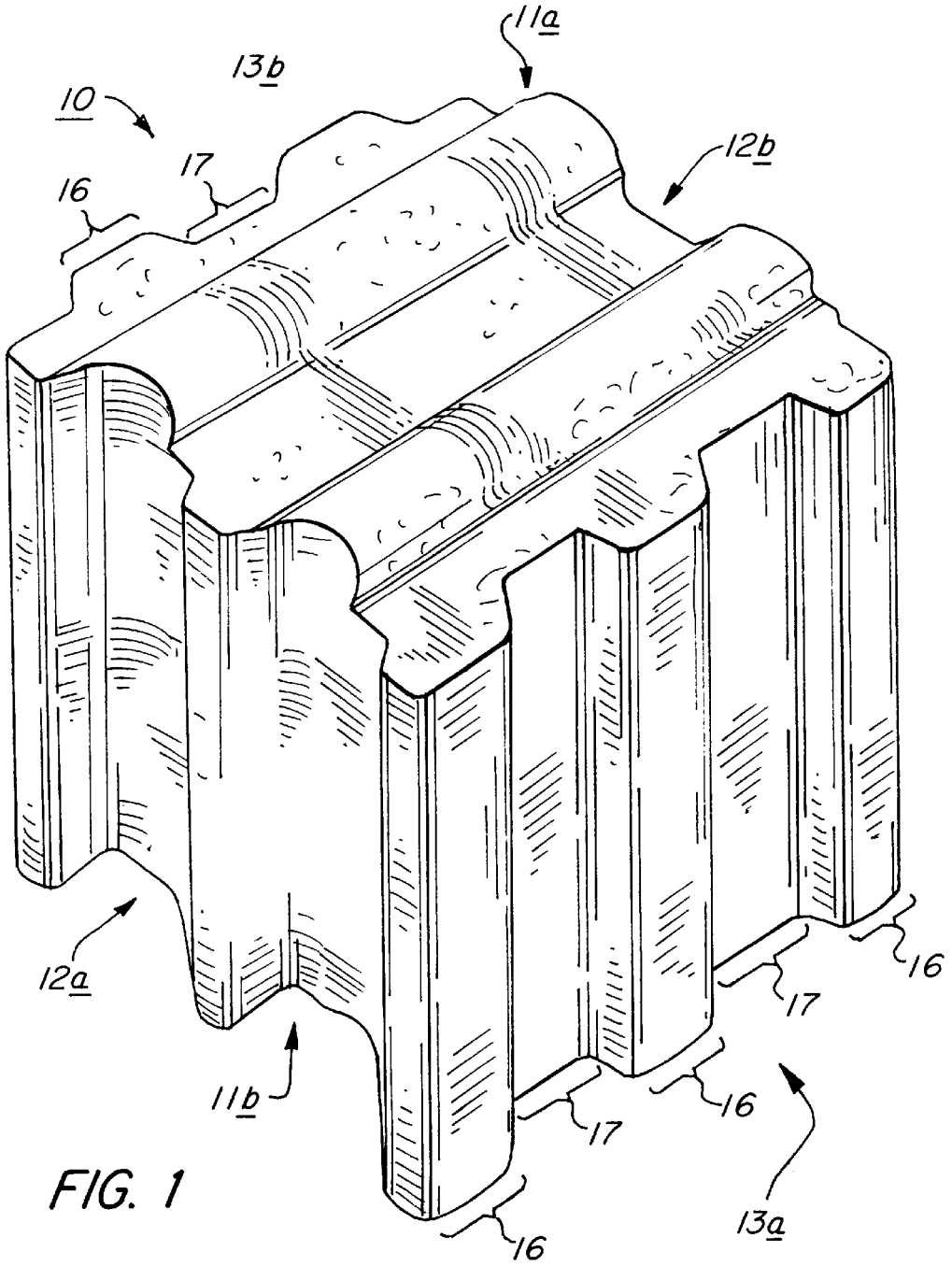
FIG. 1 is a perspective diagrammatic view of a cubic block of foam shaped according to the present invention.

Referring now to FIG. 1, a block 10 of expanded polystyrene (foam) is shown shaped according to the preferred embodiment of the present invention. The block 10 is substantially two inches on an edge and has six faces, each face having some protuberances and therefore also some recesses. In the preferred embodiment, as shown in FIG. 1, the protuberances are ribs 16 and the recesses are grooves 17; there are three ices with three ribs (and two grooves) and three faces with two ribs (and three grooves). A large number of essentially identical blocks 10 are used to fill a volume in the use of these blocks as aggregate.

The faces having the same number of ribs or grooves differ from each other on their boundaries. Thus all the faces are different, either because of having a different number of ribs than any other face, or because of having a different boundary. As a result, there is only one face on a given block that will mate with a given face of another block. Therefore, a set of blocks according to the present invention, to be fit together without void, must be assembled so that the two matable faces of each block in the set are made adjacent. Specifically, still referring to FIG. 1, the three faces 11*a*, 12*a*, 13*a*, which exhibit the three different boundaries of blocks 10 according to the preferred embodiment, must be made to mate with the faces 11*a*, 12*b*, and 13*b*, respectively, when assembling a number of blocks so as not to have any significant space between the blocks. Such a void-free assembly is the most efficient assembly for transporting blocks to an application.

Since for a void-free assembly the face of each block must be mated with a particular face of another block, for each face of the given block, there is only one way out of a total of six ways to orient an adjacent block. Therefore, given a number N of blocks the probability of arranging the N blocks in a close-fitting assembly, assuming the blocks are always oriented correctly so that ribs and grooves line up, is:

$$\left(\frac{1}{6}\right)^{6N} N!$$

the N! accounting for the indistinguishability of the blocks. Thus, there is only a remote possibility that, in filling a volume with shapes according to the present invention, the shapes will end up organized without void. The overwhelmingly more probable result will be any one of a large number of arrangements that provide essentially the same significant void.

Figure 2:
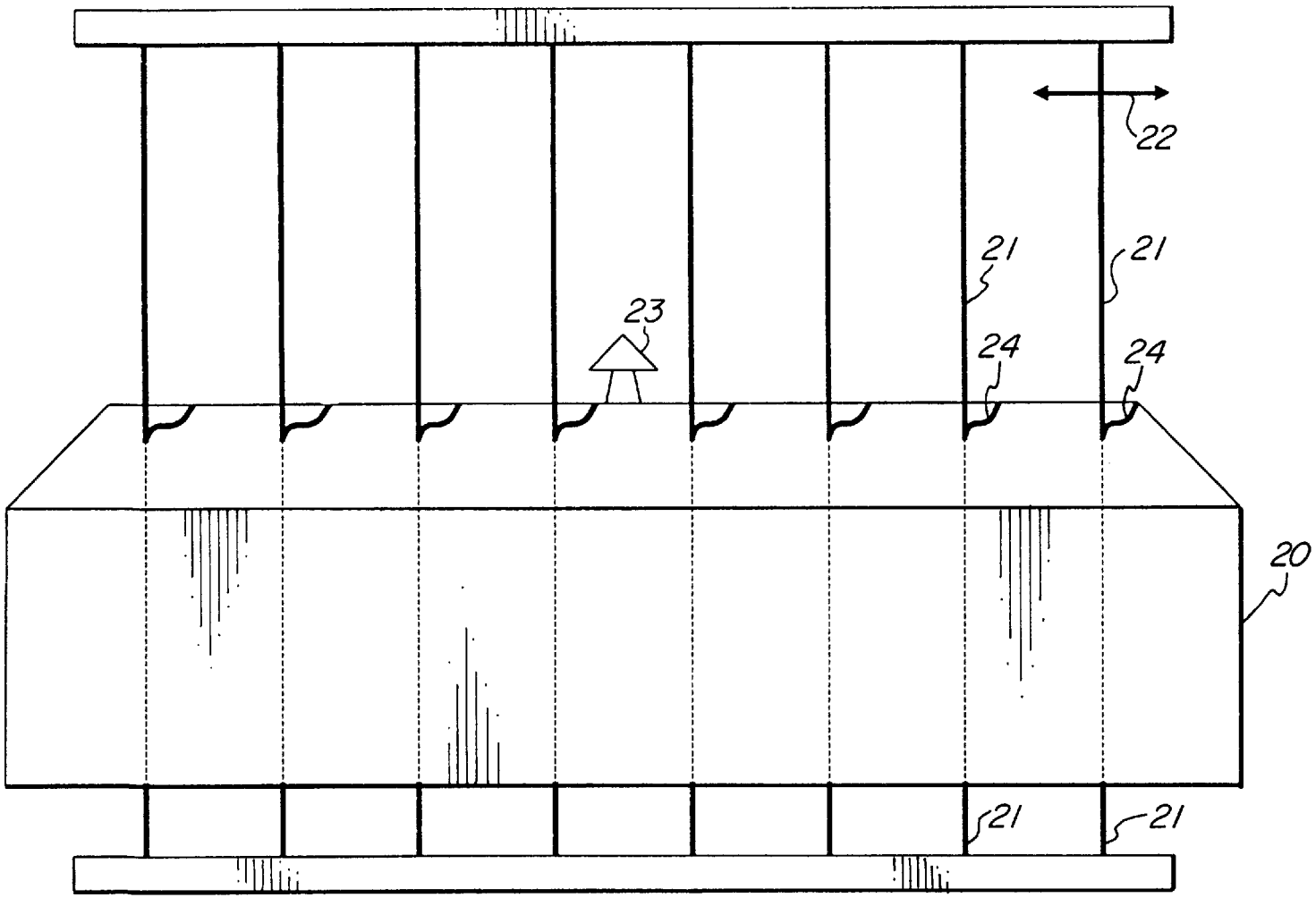
FIG. 2 is a view of the process of manufacture of blocks shaped according to the present invention.

Referring now to FIG. 2, an example of how to manufacture blocks according to the preferred embodiment is shown. An initial volume of foam 20 is shown being cut by heated wires 21, the wires moving in unison in a side-to-side motion 22, and the block being pushed or pulled through the wires in a direction 23 to cause cuts 24. The result of this operation is a family of undulating cut lines 24 in the solid initial volume 20.

Figure 3A:
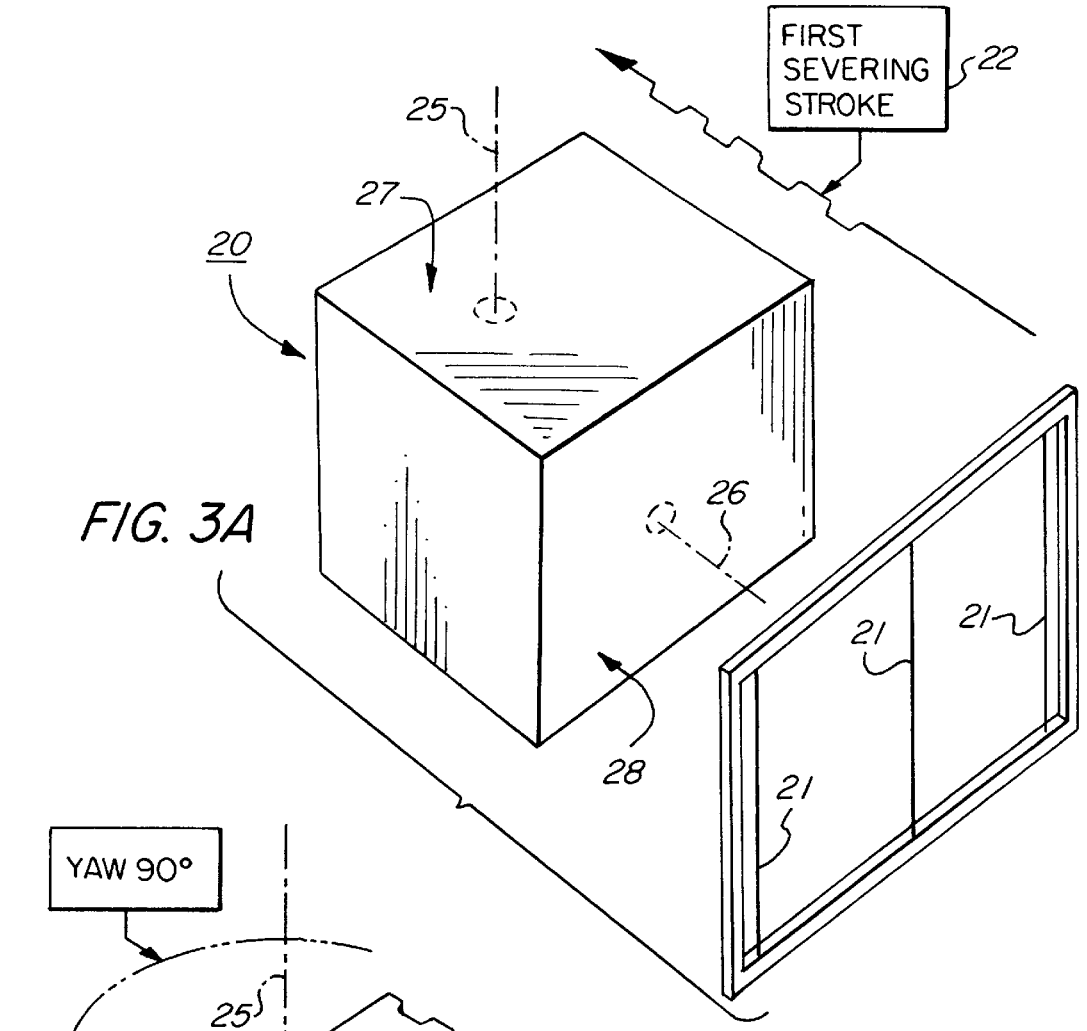
FIGS. 3A–F are illustrations of the overall process of manufacture of blocks according to the present invention.
Figure 3B:
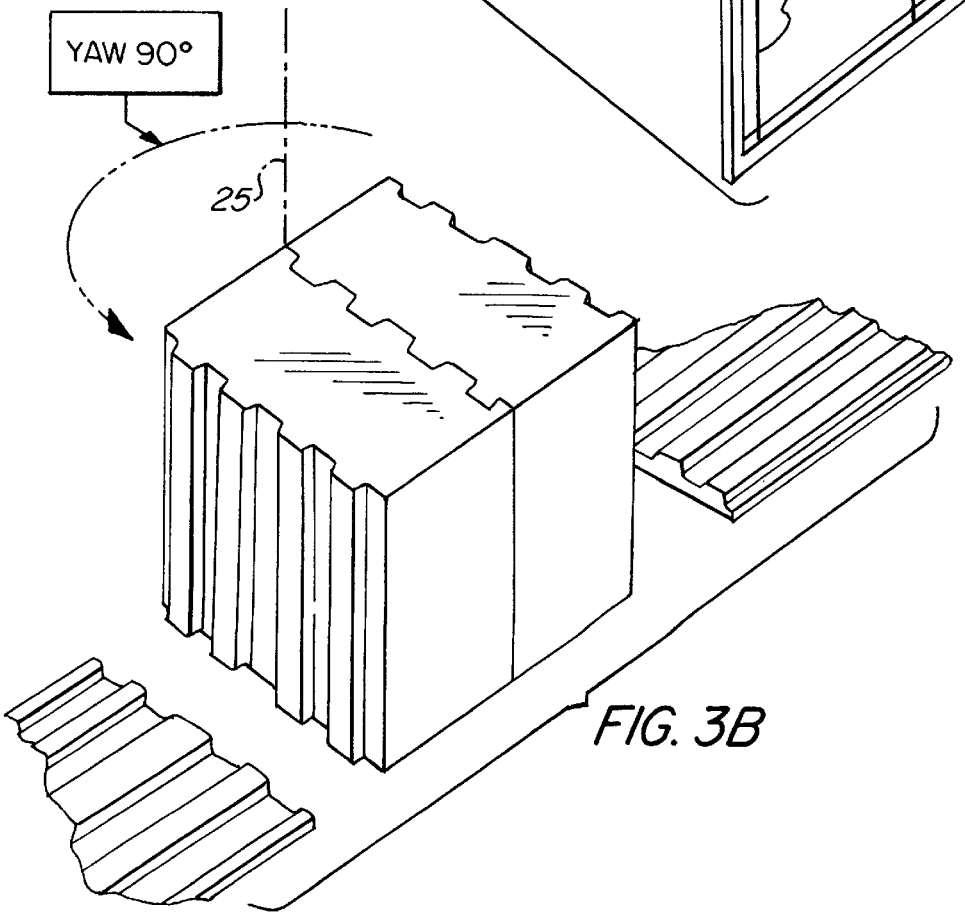
Figures 3C, 3D:
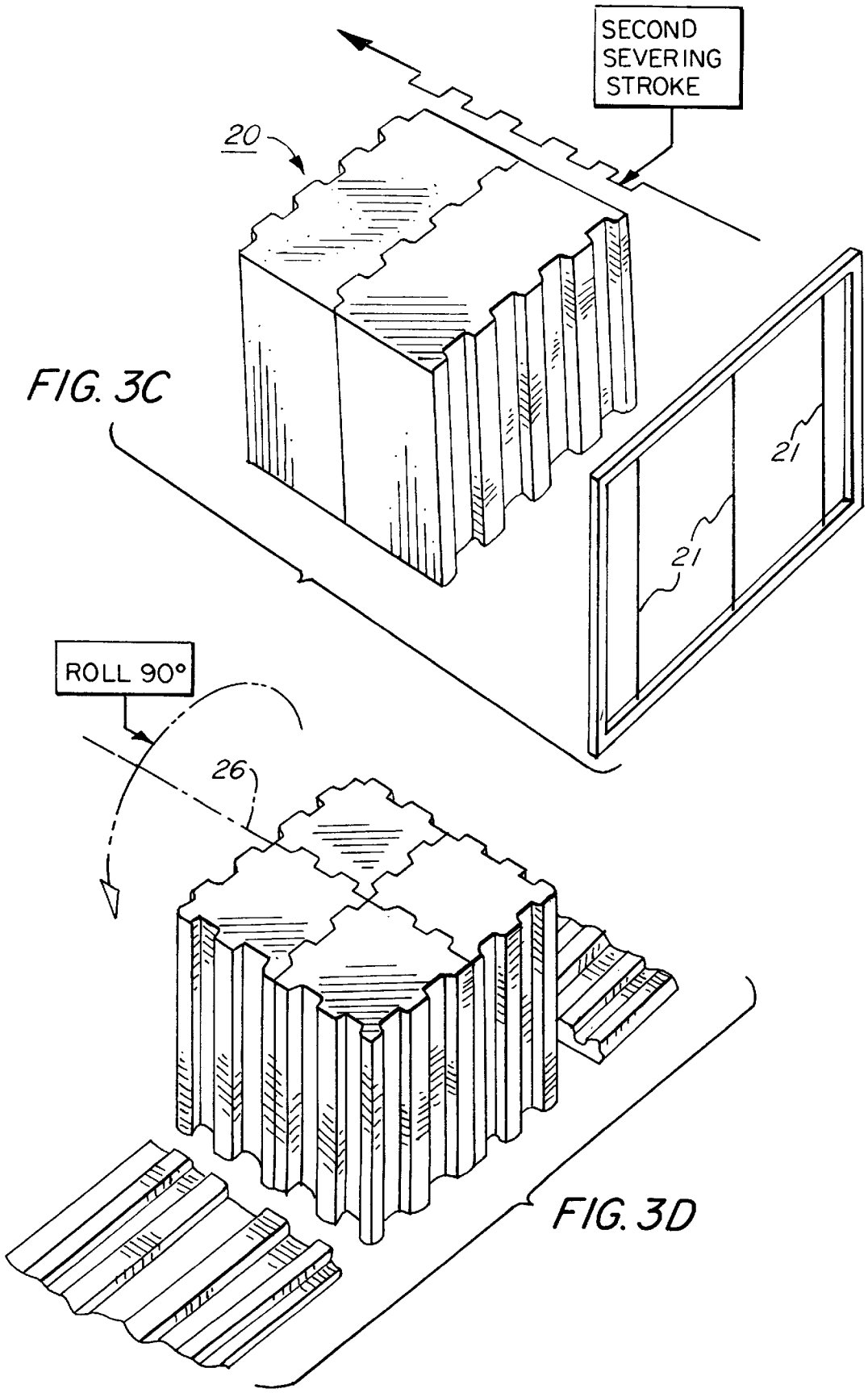
Figure 3E:
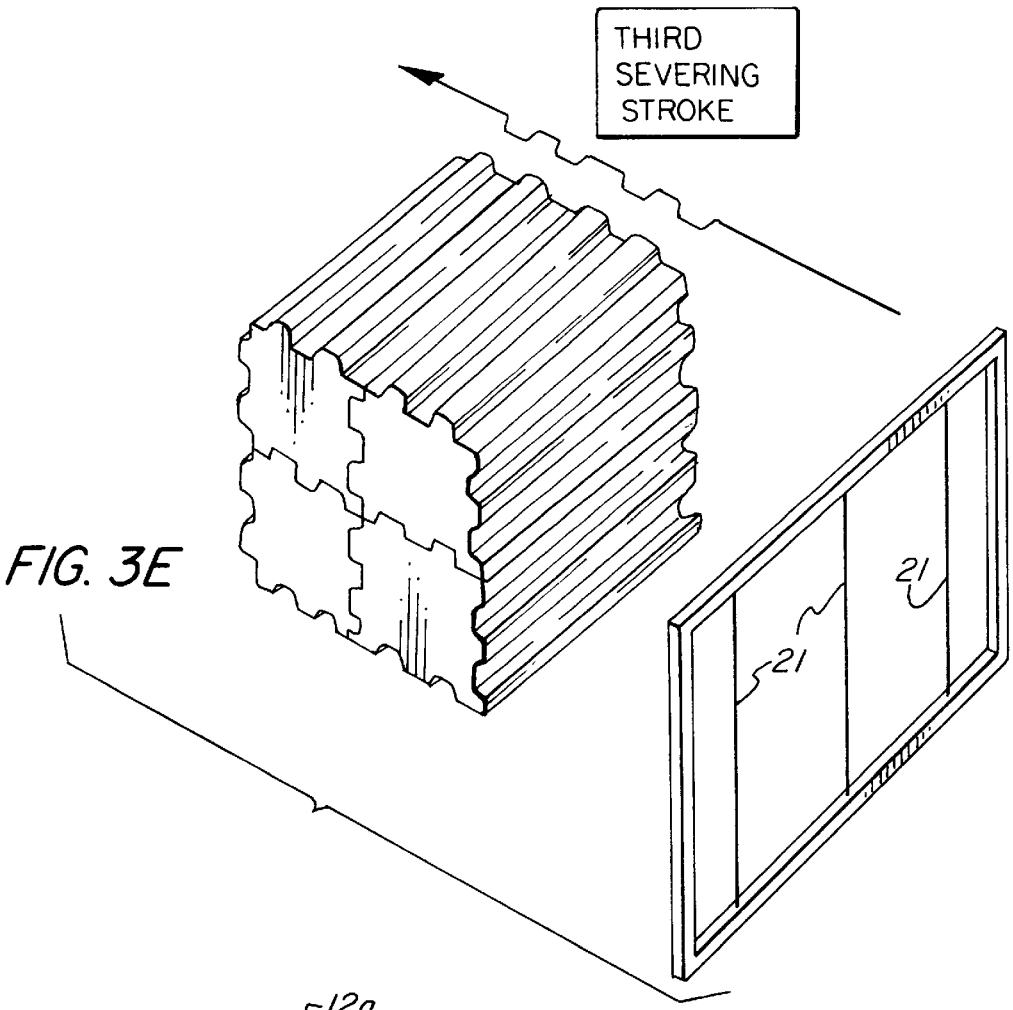
Figure 3F:
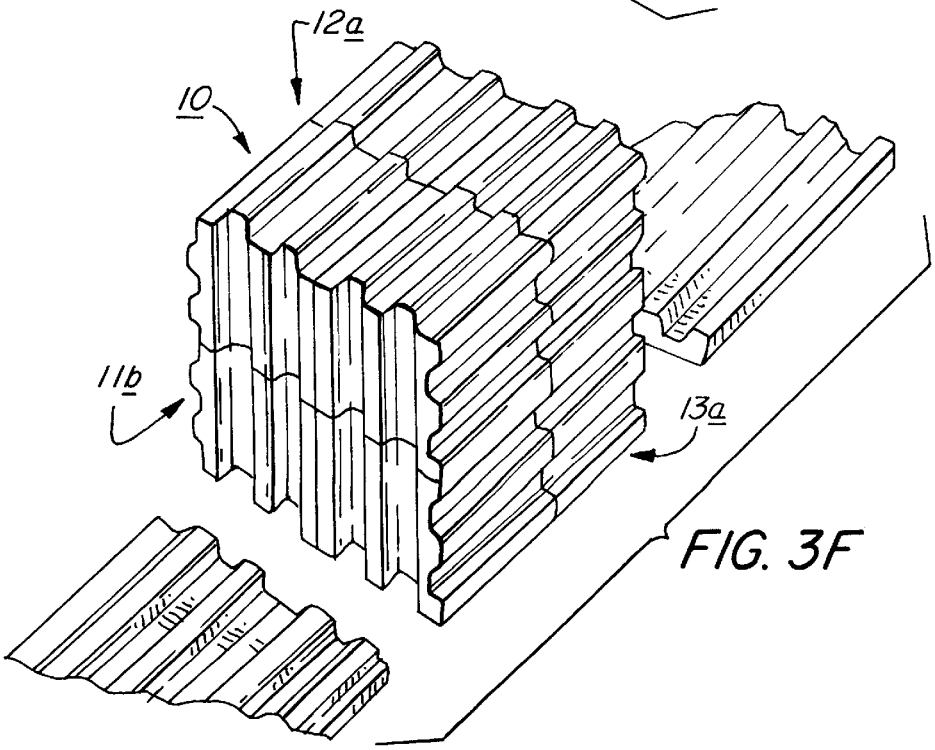

Referring now to FIGS. 3A–F, the overall process corresponding to the particular step indicated in FIG. 2 is shown. As indicated in FIG. 3A, the initial volume 20 is first oriented so as to have a first face 27 oriented perpendicular to a fixed vertical axis 25 aligned parallel to the heated wires 21, and a second face 28 perpendicular to a fixed horizontal axis 26 extending in a direction leading from the second face to the heated wires. Then the initial volume 20 is pulled through the heated wires 21 three times, the first time in the original orientation. Before the second cut, the initial volume 20 is yawed 90° (i.e. rotated 90° about the vertical axis 25) as shown in FIG. 3B. After the second cut (FIG. 3C), the initial volume is rolled 90° (i.e. rotated 90° about the horizontal axis 26) as shown in FIG. 3D. Finally, the third cut is made (FIG. 3E). The result (FIG. 3F) is a large number of blocks in a close-fitting, no-void configuration, ideal for transport to an application. The blocks 10 are solid, i.e. do not have internal voids or passageways, and are essentially identical.

Figure 4A:
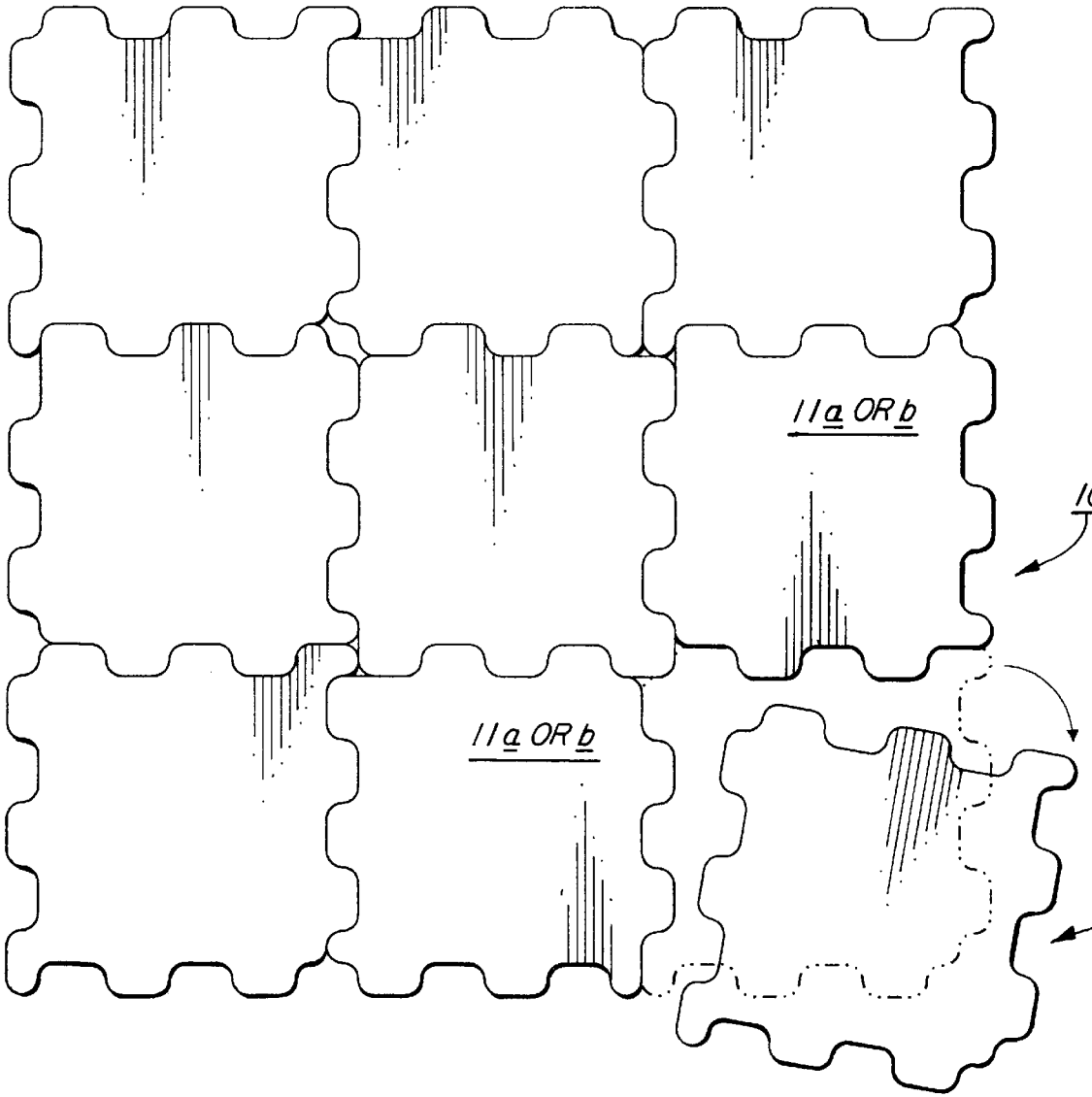
FIGS. 4A–C are respective top, front and side views of the different faces of the block shown in FIG. 1.
Figure 4B:
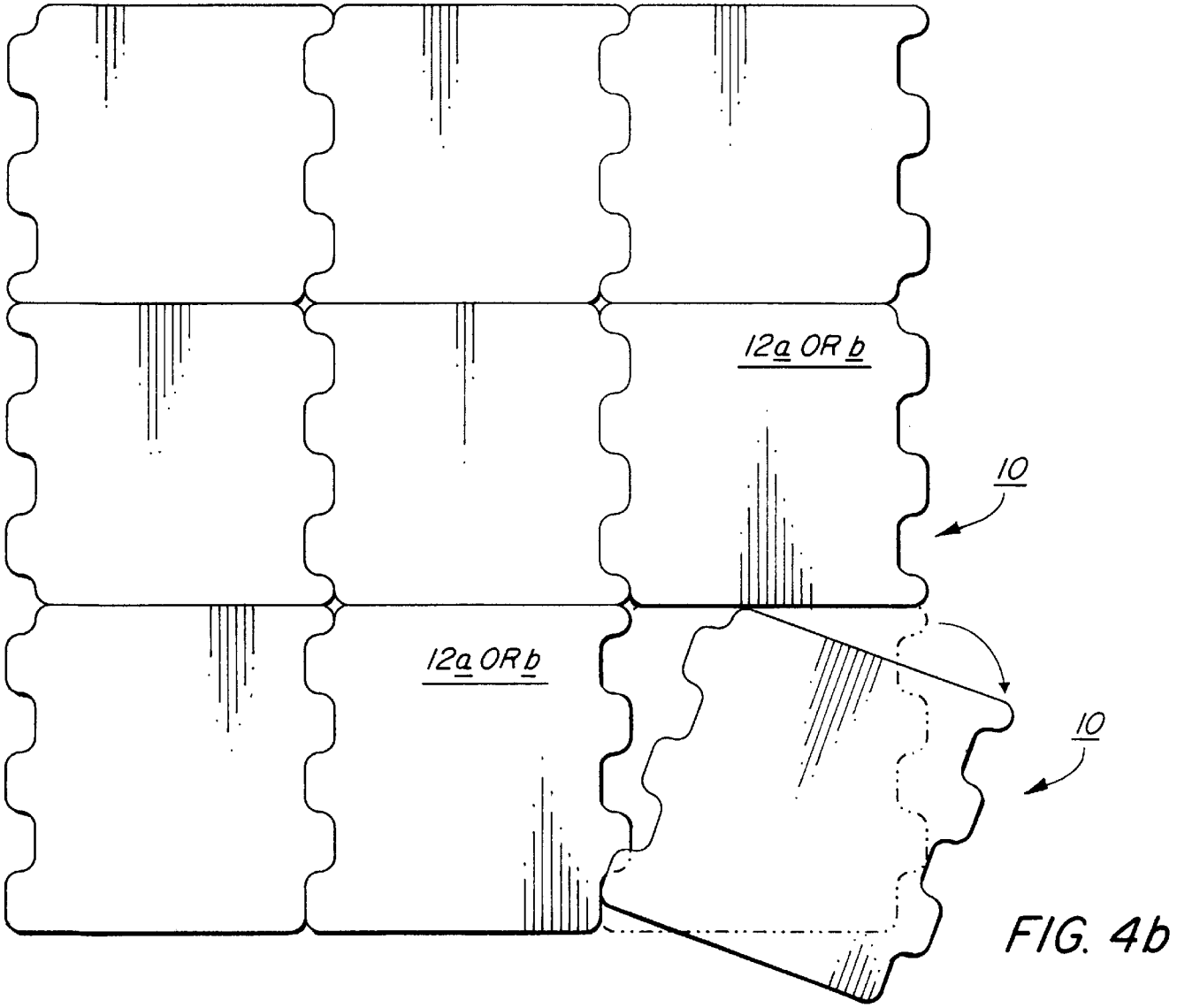
Figure 4C:
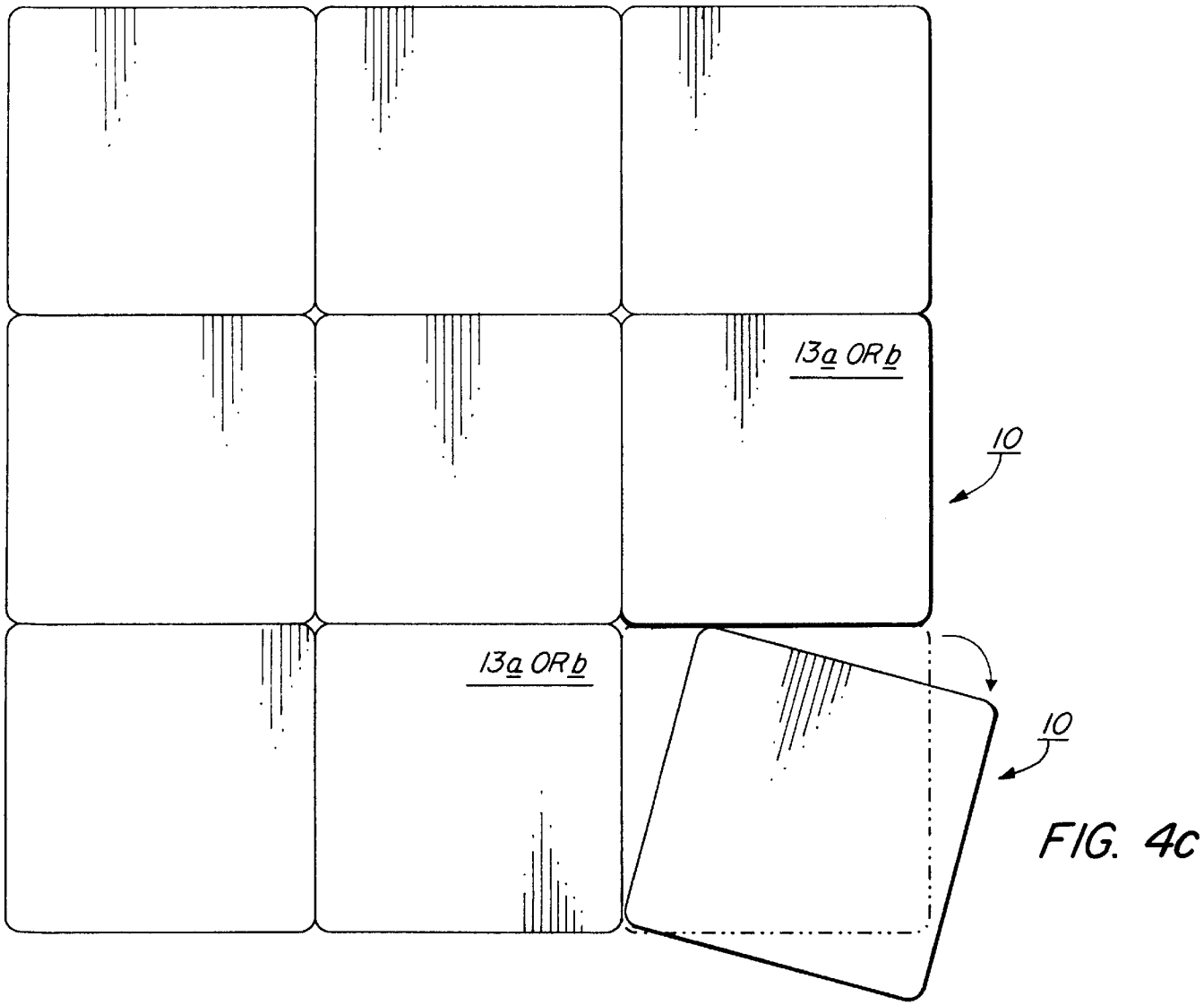

Referring now to FIGS. 4A–C, three views of mated shapes according to the preferred embodiment are shown, each a view of a different face of the block 10 shown in FIG. 1. FIG. 4A is a plan view of top face 11*a*; FIG. 4B is an elevation view of front face 12*a*; and FIG. 4C is an elevation view of side face 13*a*. As can be discerned from these illustrations, the shape of the preferred embodiment is almost interlocking. Thus, the initial volume, when cut according to FIG. 2, is not difficult to hold assembled compactly together without void, for storage or transport to an application.

In the preferred embodiment, the shaped blocks of the present invention are made of recycled expanded polystyrene, thereby providing benefit to the environment beyond providing an option to gravel mining.

Having now described the invention, and the advantageous new and useful results obtained thereby, it will be appreciated that other forms, varying in both size and shape from the preferred embodiment, also fall within the scope of the present invention. In particular, some applications may require higher density foam than is usually used, or shapes made of material other than foam; the present invention is not intended to be confined to foam or even foam of any particular range of density or compressive strength. The protuberances of a block according to the present invention can be substantially more complex than in the preferred embodiment, and may be more or less interlocking than in the preferred embodiment, depending on how important it is to make transport easy. Moreover, the blocks may be colored so to provide an indication of the use of the block aggregate, such as for example, for covering and for thermally insulating cables or splice and junction boxes buried underground.

What is claimed is:

1. A plurality of specially-shaped solid blocks for use underground as aggregate, the blocks having elongated protuberances and mating recesses on each face, the protuberances and mating recesses on a face all mutually parallel and also parallel to an edge of the face, the protuberances and mating recesses on each face oriented in one of a plurality of possible orientations, each solid block having at least two different orientations of protuberances and mating recesses in that if any one of the blocks is rotated about an axis through its center and parallel to an edge of a face so as to rotate into view different faces, the protuberances and mating recesses continue in one direction, and if the same block is then rotated about another axis perpendicular to the first axis and so as to again rotate into view different faces, the protuberances and mating recesses alternate in alignment by ninety degrees, thereby providing that the plurality of blocks fit closely together only when arranged in a small fraction of the number of ways the blocks can be arranged, and providing a pre-determined void in a volume when distributed throughout the volume with some minor disorder.

2. Specially-shaped blocks as claimed in claim 1, with N protuberances on one-half of the faces of each block and N+1 protuberances on the other half of the faces of each block.

3. A plurality of specially-shaped blocks as claimed in claim 1, wherein each block has two protuberances on one-half of its faces and three protuberances on the other half.

4. A plurality of specially-shaped blocks as claimed in claim 1, wherein the blocks are made of a material that is non-biodegradable.

5. A plurality of specially-shaped blocks as claimed in claim 1, wherein each block is made from expanded polystyrene.

6. A plurality of specially-shaped blocks as claimed in claim 5, wherein the material used to make the blocks has been recycled.

7. A plurality of specially-shaped blocks as claimed in claim 1, wherein the blocks are colored to indicate their use.

8. A plurality of specially-shaped solid blocks for use underground as aggregate, the blocks having elongated protuberances and mating recesses on each face, the protuberance and each mating recess lying substantially in a line, the protuberances and mating recesses on each face substantially mutually parallel, the protuberances and mating recesses on a face also all parallel to an edge of the face, each solid block having protuberances and mating recesses on two different faces aligned in two different directions in the that if any one of the blocks is rotated about an axis through its center and parallel to an edge of a face so as to rotate into view different faces, the protuberances and mating recesses continue in one direction, and if the same block is then rotated about another axis perpendicular to the first axis and so as to again rotate into view different faces, the protuberances and mating recesses alternate in alignment by ninety degrees, thereby providing that the plurality of blocks fit closely together only when arranged in a small fraction of the number of ways the blocks can be arranged, and providing a pre-determined void in a volume when distributed throughout the volume with some minor disorder.

* * * * *

UNITED STATES PATENT AND TRADEMARK OFFICE

CERTIFICATE OF CORRECTION

PATENT NO. : 6,053,661
DATED : April 25, 2000
INVENTOR(S) : Lewis

It is certified that error appears in the above-identified patent and that said Letters Patent is hereby corrected as shown below:

Column 3,
Line 23, after "psi" "," should be --.--.

Column 4,
Line 16, "ices" should be --faces--.

Column 6, Claim 8,
Line 36, "the" should be --each--.
Line 42, "the" should be deleted.

Signed and Sealed this

Third Day of July, 2001

*Attest:*

Nicholas P. Godici

*Attesting Officer*

NICHOLAS P. GODICI
*Acting Director of the United States Patent and Trademark Office*